United States Patent [19]

Howard et al.

[11] Patent Number: 4,848,567

[45] Date of Patent: Jul. 18, 1989

[54] HEATING DEVICE HAVING A REMOVABLE CARRIER

[75] Inventors: Keith Howard; Jim Sherrill, both of Cookeville; Robert Kirby, Sparta; Bill A. Malone, Cookeville, all of Tenn.

[73] Assignee: Tutco, Inc., Cookeville, Tenn.

[21] Appl. No.: 117,912

[22] Filed: Nov. 3, 1987

[51] Int. Cl.[4] ..... B65D 85/00

[52] U.S. Cl. ..... 206/332; 219/532; 336/199; 336/207

[58] Field of Search ..... 174/138 J; 206/328, 206/330, 332; 219/532, 374, 375, 376; 336/207, 199

[56] References Cited

U.S. PATENT DOCUMENTS

| | | | |
|---|---|---|---|
| 2,856,500 | 10/1958 | Hartman | 174/138 J X |
| 2,927,956 | 11/1960 | Reisch | 174/138 J |
| 3,218,437 | 11/1965 | Laing | 174/138 J |
| 3,302,003 | 1/1967 | Kinney | 174/138 J X |
| 3,561,111 | 2/1971 | Beck et al. | 336/207 X |
| 3,798,417 | 3/1974 | Bittner | 219/532 |
| 3,992,609 | 11/1976 | Alexander | 219/532 |
| 4,209,686 | 6/1980 | Moglia et al. | 219/375 |
| 4,528,441 | 7/1985 | Seal et al. | 219/532 |

FOREIGN PATENT DOCUMENTS

| | | | |
|---|---|---|---|
| 603656 | 6/1948 | United Kingdom | 174/138 J |

*Primary Examiner*—Thomas J. Kozma

*Attorney, Agent, or Firm*—Berman, Aisenberg & Platt

[57] ABSTRACT

A heating device, such as a heating coil for use in apparatus to be heated, has a removable flexible strip carrier which enables the coil, already supported on ceramic insulators and carried by brackets, to be readily installed in the apparatus. The disposable or reusable strip carrier is notched for supporting the insulators and is easily removed after installation of the device.

6 Claims, 2 Drawing Sheets

HEATING DEVICE HAVING A REMOVABLE CARRIER

FIELD OF THE INVENTION

This invention relates to heating coils for electrical appliances.

BACKGROUND OF THE INVENTION

Problems occur with handling and transportation of heating coils for insertion in a domestic appliance such as an electric clothes dryer, or other apparatus using a heating coil. Heating coils are fragile, and easily damaged.

The patent to Zack, U.S. Pat. No. 2,965,856, shows a package for an electrical inductor coil adhesively attached to a stiff cardboard backing and secured between two backing sheets. Deakin, U.S. Pat. No. 3,069,751, shows an apertured cardboard support in which contacts are secured by means of adhesive tape. U.S. Pat. No. 3,199,183 to Napoli shows studs attached to apertures in a tape-like workpiece for use as welding studs. The tape may be paper or other suitable material. The patent to Herb, U.S. Pat. No. 3,611,562, shows a method for attaching micro circuit packs to a panel board in which electrical connectors are mounted on a plastic strip in the required locations enabling the carrier strip to be positioned over upstanding pins on the circuit panel such that the pins extend through the respective electrical connectors. Connell, U.S. Pat. No. 3,808,668, describes a soluble matrix for maintaining components such as strands of wire in any desired configuration, for soldering or other process, following which the matrix is dissolved away. Spooner, U.S. Pat. No. 3,396,461, relates to cladding the terminals of a printed circuit board, in which a comb-like strip of electrically conductive material, arranged on a backing strip, is positioned on the terminals, and the blades of the comb aligned to register with the terminal for removing the backing strip.

SUMMARY OF THE INVENTION

The invention is a heating device having a disposable or reusable strip carrier preferably made of cardboard, plastic or other flexible material, which facilitates transportation of an open-coil heating element assembly from one point to another. The heating element assembly is positioned on the carrier to support the assembly at or near its intended final position, enabling transportation in this position. On arrival, the element is connected to the device to be heated, and the carrier is removed for reuse or disposal. The carrier comprises an elongated strip, notched at intervals along its length, each notch engaging a ceramic support of the heating element which is carried by an L-shaped metal support. The cardboard carrier may support a single heating element or a double heating element.

It is an object of the invention to provide an open coil heating element assembly supported on a disposable or reusable strip carrier.

DETAILED DESCRIPTION OF THE INVENTION

The invention relates to a heating device having a removable carrier for supporting the length of the device and extending substantially along the length of an open-coil heating element assembly. The removable carrier strip is generally flexible and may appropriately be made of cardboard, plastic or flexible metal. The device of the invention enables a heating coil for heating apparatus, such as an electric dryer or duct heater, to be transported in approximately the configuration in which it will be used, having the insulator supports already attached to the coil and having brackets, for securing the heating coil to the apparatus attached to the insulating supports. The brackets may carry either a single heating coil or a double heating coil, such as that illustrated in FIGS. 1 to 5.

The heating element may be inserted in the heating apparatus with the carrier still in place, and the carrier is removed for disposal or re-use once the open-coil element is installed. The carrier may be of any suitable flexible strip material.

Figure 2:
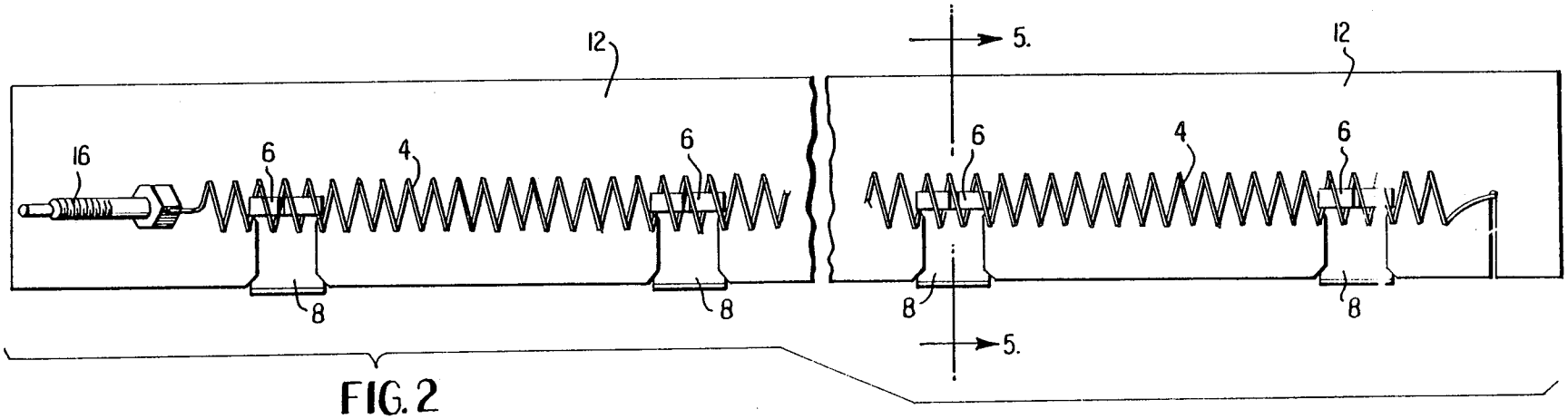
FIG. 2 is a side view of the invention of FIG. 1.
Figure 3:
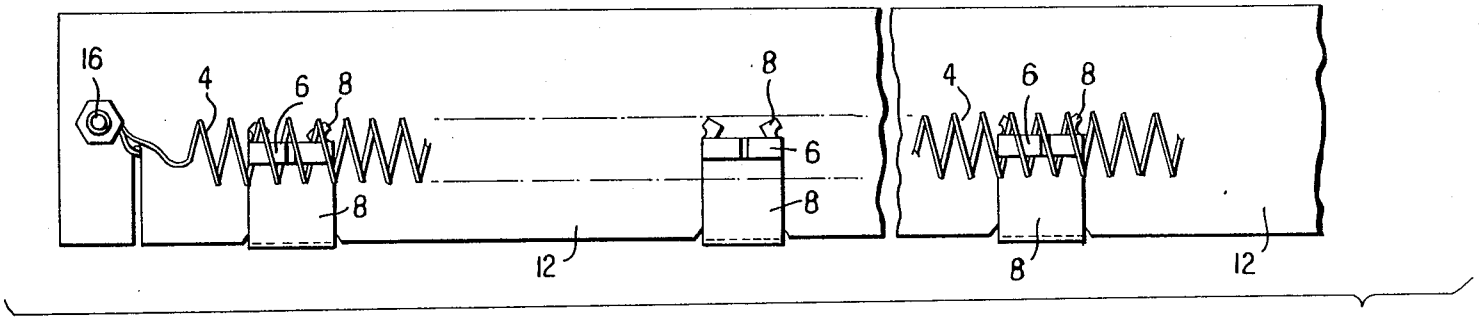
FIG. 3 is the other side view of the invention of FIG. 1.
Figure 5:
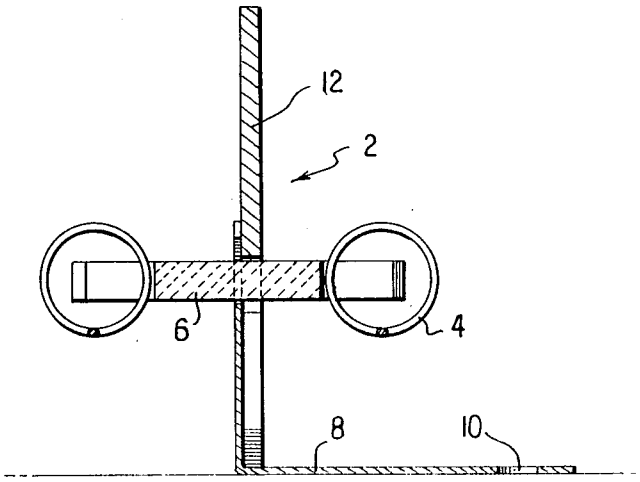
FIG. 5 is a cross-section taken on line 5—5 of FIG. 2.
Figure 4:
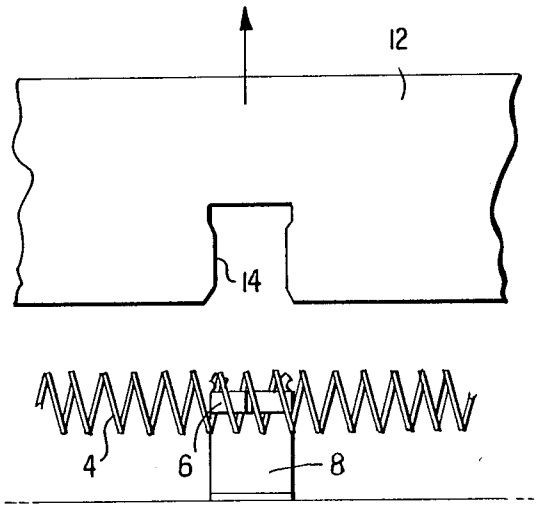
FIG. 4 is a broken away side view showing removal of the supporting carrier.

Referring now to the figures, in which like numerals represent like parts, FIGS. 1 to 5 show a double heating coil of the invention carried by double insulating connectors on a removable strip support. In an alternative embodiment, only a single heating coil would be carried on single insulating connectors along the strip. FIGS. 1 to 5 show device 2 having heating coils 4 supported on insulators 6, such as ceramic insulators. Other insulating material may be used. Insulators are spaced appropriately along the length of the heating coil, as known to one skilled in the art. Ceramic insulators 6 are supported by L-shaped brackets 8, which may be of metal, and which are not in contact with the heating coil. Brackets 8, which may be made of any suitable substantially rigid material, are affixed to the appliance in which the heating coil is to be used, by means of fasteners through apertures 10, or by other appropriate means. FIG. 4 clearly shows carrier strip 12 having notches 14 cut therein, shaped to engage ceramic supports 6 along the length of the coil. Notches 14 are cut with appropriate spacing according to the spacing of the support structures for coil 4. Notches 14 may alternatively be designed to engage brackets 8 instead of, or as well as, engaging insulators 6. Other designs will be apparent to one skilled in the art.

Figure 1:
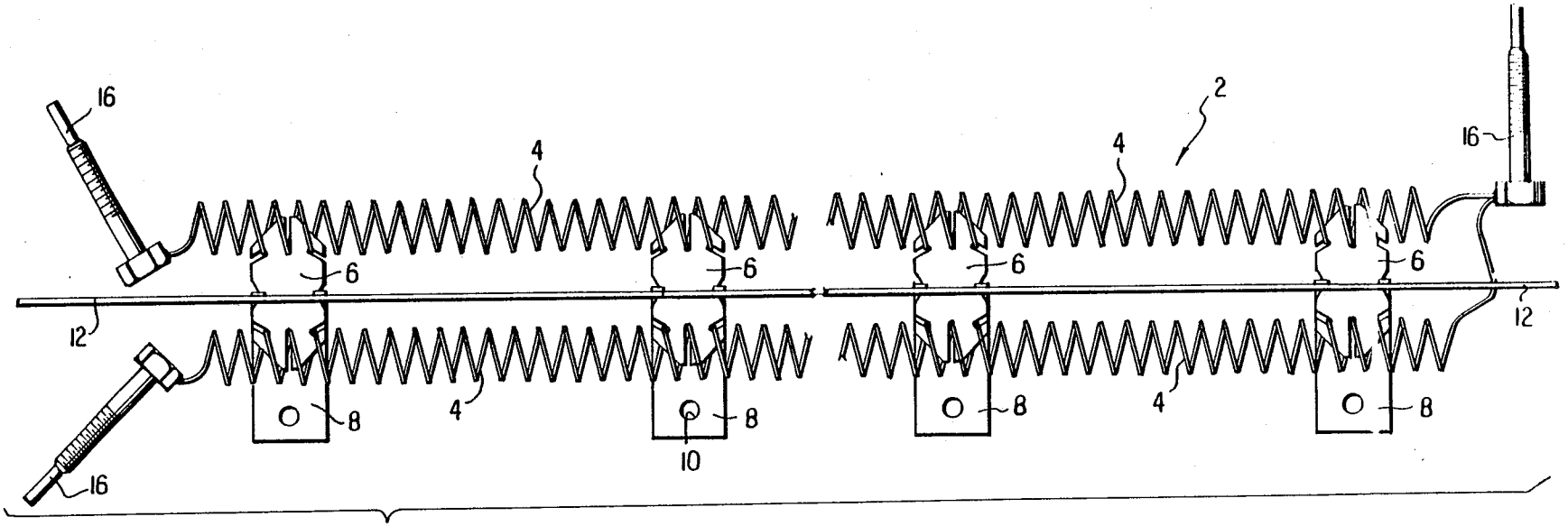
FIG. 1 is a front plan view of a heater element and carrier of the invention.

Terminals 16 are attached to each end of the coil for conducting electricity from the electrical source through the coil, as shown in FIGS. 1 to 3. Other suitable conducting terminals may alternatively be used.

The device of the invention may be made by a manual process or by a process which is partly or fully automated. The cardboard strip is notched to accept the insulators and cut to size. The ceramic insulators are secured to the metal brackets and inserted into the notches in the cardboard, and coiled heating wire is snapped into the ceramic insulating holders and the terminal pins attached. Each unit is packaged for shipping held in position on the strip material in a configuration suitable for application to its intended use environment.

The device is simple and economical to make, package and use and shows improved practicality for installation on the work site. The heating device of the invention is suitable for use either as original or replacement parts for heating apparatus.

While the invention has been described above with respect to certain embodiments thereof, it will be appreciated that variations and modifications may be made without departing from the spirit and scope of the invention.

What is claimed is:

1. A heating device, comprising:

flexible heat conducting means for inserting in an apparatus to be heated, insulators supporting the heat conducting means, an L-shaped bracket supporting each insulator, and a removable carrier strip comprising notches for engaging the insulators, said strip supporting the device substantially along the length of the heat conducting means, one arm of each L-shaped bracket supporting each said insulator, a longitudinal axis of each insulator being parallel to the other arm of the L-shaped bracket, the arm supporting the insulator being in a plane parallel to the strip, wherein the strip is removed before installation of the heating means.

2. A device of claim 1 wherein the strip is flexible.

3. A device of claim 1 wherein the strip comprises cardboard.

4. A device of claim 1 wherein the carrier strip comprises plastic strip material.

5. A device of claim 1 wherein the carrier strip comprises metal strip material.

6. A heating device, comprising:

flexible heat conducting means for inserting in an apparatus to be heated, insulators for supporting the heat conducting means, a bracket supporting each insulator, and a removable carrier strip comprising notches for supporting the insulators, said strip extending substantially along the length of the heat conducting means, the insulator-supporting plane of the brackets being parallel to the plane of the strip, wherein the strip is removed before installation of the heating means.

* * * * *